US011209224B2

(12) United States Patent
Stillman et al.

(10) Patent No.: US 11,209,224 B2
(45) Date of Patent: Dec. 28, 2021

(54) MIXING BETWEEN FLOW CHANNELS OF CAST PLATE HEAT EXCHANGER

(71) Applicant: United Technologies Corporation, Farmington, CT (US)

(72) Inventors: Wililam P. Stillman, Sturbridge, MA (US); Michael A. Disori, Glastonbury, CT (US); Dave J. Hyland, Portland, CT (US); Carl R. Verner, Windsor, CT (US)

(73) Assignee: Raytheon Technologies Corporation, Farmington, CT (US)

( * ) Notice: Subject to any disclaimer, the term of this patent is extended or adjusted under 35 U.S.C. 154(b) by 14 days.

(21) Appl. No.: 16/281,206

(22) Filed: Feb. 21, 2019

(65) Prior Publication Data

US 2019/0323787 A1 Oct. 24, 2019

Related U.S. Application Data

(60) Provisional application No. 62/660,074, filed on Apr. 19, 2018.

(51) Int. Cl.
*F28F 13/12* (2006.01)
*F28F 3/12* (2006.01)

(52) U.S. Cl.
CPC ..... *F28F 13/12* (2013.01); *F28F 3/12* (2013.01); *F28F 2250/04* (2013.01)

(58) Field of Classification Search
CPC .... F28F 1/022; F28F 1/045; F28F 1/16; F28F 1/26; F28F 3/048; F28F 3/086; F28F 7/02; F28F 13/02; F28F 13/06; F28F 27/02; F28F 2250/04; F28F 2250/108; F28F 9/0282; F28D 1/0233; F28D 1/0246; F28D 1/05308; F28D 1/05358; F28D 1/05383; F28D 1/05391
See application file for complete search history.

(56) References Cited

U.S. PATENT DOCUMENTS 3,901,312 A * 8/1975 Pasternak ..... F28F 1/26 165/181
4,729,428 A * 3/1988 Yasutake ..... F28D 9/0062 165/153
5,323,851 A * 6/1994 Abraham ..... B21C 23/10 165/174

(Continued)

FOREIGN PATENT DOCUMENTS

EP 0132237 A2 1/1985
WO 2004/015350 A1 2/2004

OTHER PUBLICATIONS

European Search Report for EP Application No. 19169952.9 dated Sep. 26, 2019.

(Continued)

*Primary Examiner* — Jianying C Atkisson
*Assistant Examiner* — Jose O Class-Quinones
(74) *Attorney, Agent, or Firm* — Carlson, Gaskey & Olds, P.C.

(57) ABSTRACT

A heat exchanger is disclosed and includes a plate portion including a plurality of internal passages extending between an inlet and an outlet and at least one means for providing fluid communication between at least two of the plurality of internal passages.

19 Claims, 6 Drawing Sheets

(56) References Cited

U.S. PATENT DOCUMENTS

| | | | | |
|---|---|---|---|---|
| 5,689,881 | A * | 11/1997 | Kato | F28D 1/0316 29/890.053 |
| 5,784,776 | A | 7/1998 | Saito et al. | |
| 5,931,226 | A | 8/1999 | Hirano et al. | |
| 6,247,529 | B1 * | 6/2001 | Shimizu | F28F 1/022 165/177 |
| 6,253,840 | B1 * | 7/2001 | Kuroyanagi | F28D 1/0333 165/153 |
| 6,301,109 | B1 * | 10/2001 | Chu | F28F 3/12 165/165 |
| 6,422,020 | B1 | 7/2002 | Rice | |
| 6,612,808 | B2 * | 9/2003 | Lee | F01D 5/187 415/175 |
| 6,622,785 | B2 * | 9/2003 | Haegele | F28D 1/0391 138/38 |
| 8,210,814 | B2 | 7/2012 | Zausner et al. | |
| 2002/0017372 | A1 * | 2/2002 | Yano | B21C 37/151 164/113 |
| 2008/0149313 | A1 * | 6/2008 | Slaughter | F28F 13/06 165/148 |
| 2009/0321060 | A1 | 12/2009 | Chou | |
| 2013/0020063 | A1 * | 1/2013 | Fetvedt | F28F 3/12 165/168 |
| 2013/0299145 | A1 * | 11/2013 | Lee | B23P 15/26 165/165 |
| 2014/0326441 | A1 * | 11/2014 | Lee | F28F 3/02 165/185 |

OTHER PUBLICATIONS

European Search Report for European Application No. 21172153.5 dated Jun. 9, 2021.

* cited by examiner

MIXING BETWEEN FLOW CHANNELS OF CAST PLATE HEAT EXCHANGER

CROSS-REFERENCE TO RELATED APPLICATION

This application claims priority to U.S. Provisional Application No. 62/660,074 filed on Apr. 19, 2018.

BACKGROUND

A plate fin heat exchanger includes adjacent flow paths that transfer heat from a hot flow to a cooling flow. The flow paths are defined by a combination of plates and fins that are arranged to transfer heat from one flow to another flow. The plates and fins are created from sheet metal material brazed together to define the different flow paths. Thermal gradients present in the sheet material create stresses that can be very high in certain locations. The stresses are typically largest in one corner where the hot side flow first meets the coldest portion of the cooling flow. In an opposite corner where the coldest hot side flow meets the hottest cold side flow the temperature difference is much less resulting in unbalanced stresses across the heat exchanger structure. Increasing temperatures and pressures can result in stresses on the structure that can exceed material and assembly capabilities.

Turbine engine manufactures utilize heat exchangers throughout the engine to cool and condition airflow for cooling and other operational needs. Improvements to turbine engines have enabled increases in operational temperatures and pressures. The increases in temperatures and pressures improve engine efficiency but also increase demands on all engine components including heat exchangers.

Turbine engine manufacturers continue to seek further improvements to engine performance including improvements to thermal, transfer and propulsive efficiencies.

SUMMARY

A heat exchanger according to a featured exemplary embodiment of this disclosure, among other possible things includes a plate portion including a plurality of internal passages extending between an inlet and an outlet and at least one means for providing fluid communication between at least two of the plurality of internal passages.

In a further embodiment of the foregoing heat exchanger, the means for providing fluid communication between at least two of the plurality of internal passages comprises at least one crossover passage.

In a further embodiment of any of the foregoing heat exchangers, the plurality of internal passages are separated by internal walls and at least one crossover passage extends through an internal wall.

In a further embodiment of any of the forgoing heat exchangers, the at least one crossover passage comprises a plurality of crossover passages spaced apart from each other between the inlet and the outlet.

In a further embodiment of any of the forgoing heat exchangers, the plurality of crossover passages includes several crossover passages between adjacent ones of the plurality of passage between the inlet and the outlet.

In a further embodiment of any of the forgoing heat exchangers, the plurality of crossover passages are disposed within a first length from the inlet that is no more than 15% of a total length between the inlet and the outlet.

In a further embodiment of any of the forgoing heat exchangers, the first length is no more than 10% of the total length between the inlet and the outlet.

In a further embodiment of any of the forgoing heat exchangers, the plurality of crossover passages include more crossover passages within a first length from the inlet that is no more than 15% of a total length between the inlet and the outlet than are disposed after the first length.

In a further embodiment of any of the forgoing heat exchangers, at least one crossover passage is transverse to the plurality of internal passages.

In a further embodiment of any of the forgoing heat exchangers, at least one crossover passage is disposed at an angle relative to the internal passages that is greater than 90 degrees.

In a further embodiment of any of the forgoing heat exchangers, the plate portion includes a width with a first side and a second side and the plurality of internal passages are aligned across the width and the at least one means for providing fluid communication between at least two of the plurality of internal passages comprises a plurality of crossover passages that direct flow between the plurality of internal passages toward the first side and the second side.

In a further embodiment of any of the forgoing heat exchangers, the plate portion includes a width with a first side and a second side and the plurality of internal passages are aligned across the width and the at least one means for providing fluid communication between at least two of the plurality of internal passages comprises a plurality of crossover passages that direct flow between the plurality of internal passages toward a center between the first side and the second side.

In a further embodiment of any of the forgoing heat exchangers, at least one crossover passage includes a cross-sectional shape that is one of circle, oblong, stadium and elliptical.

In a further embodiment of any of the forgoing heat exchangers, the plurality of internal passages includes at least two rows of passages spaced apart vertically and the at least one crossover passages extends between at least two internal passages in different rows.

In a further embodiment of any of the forgoing heat exchangers, the plate portion is a one piece cast part including a plurality of cast fins extending from an outer surface.

A cast heat exchanger plate according to another featured exemplary embodiment of this disclosure, among other possible things includes a one piece cast plate portion including a plurality of cooling fins extending from an outer surface, at least one internal wall defining at least two internal passages extending between an inlet and an outlet within the cast plate portion and at least one crossover passage extending through the internal wall providing fluid communication between the at least two internal passages.

In a further embodiment of any of the forgoing cast heat exchanger plate, the at least one crossover passage comprises a plurality of crossover passages include more crossover passages within a first length from the inlet that is no more than 15% of a total length between the inlet and the outlet than are disposed after the first length.

In a further embodiment of any of the forgoing cast heat exchanger plates, at least two internal passages are spaced apart vertically within separate rows of internal passages and the at least one crossover passages extends between at least two internal passages in separate rows.

A core assembly for a heat exchanger according to another featured exemplary embodiment of this disclosure, among other possible things includes, a core assembly for a heat exchanger includes at least one core plate defining internal features of a heat exchanger plate portion. The core plate including passage defining features disposed between gaps defining at least one internal wall between at least two internal passages and at least one crossover feature between the passage defining features for defining a crossover passage through the internal wall providing fluid communication between the at least two internal passages.

In further embodiment of the foregoing core assembly for a heat exchanger, the at least one crossover feature comprises a plurality of crossover features arranged between ends of the passage defining features and more of the plurality of crossover features are disposed within a first length from a first open end that is no more than 15% of a total length between open ends.

Although the different examples have the specific components shown in the illustrations, embodiments of this disclosure are not limited to those particular combinations. It is possible to use some of the components or features from one of the examples in combination with features or components from another one of the examples.

These and other features disclosed herein can be best understood from the following specification and drawings, the following of which is a brief description.

DETAILED DESCRIPTION

Figure 1:
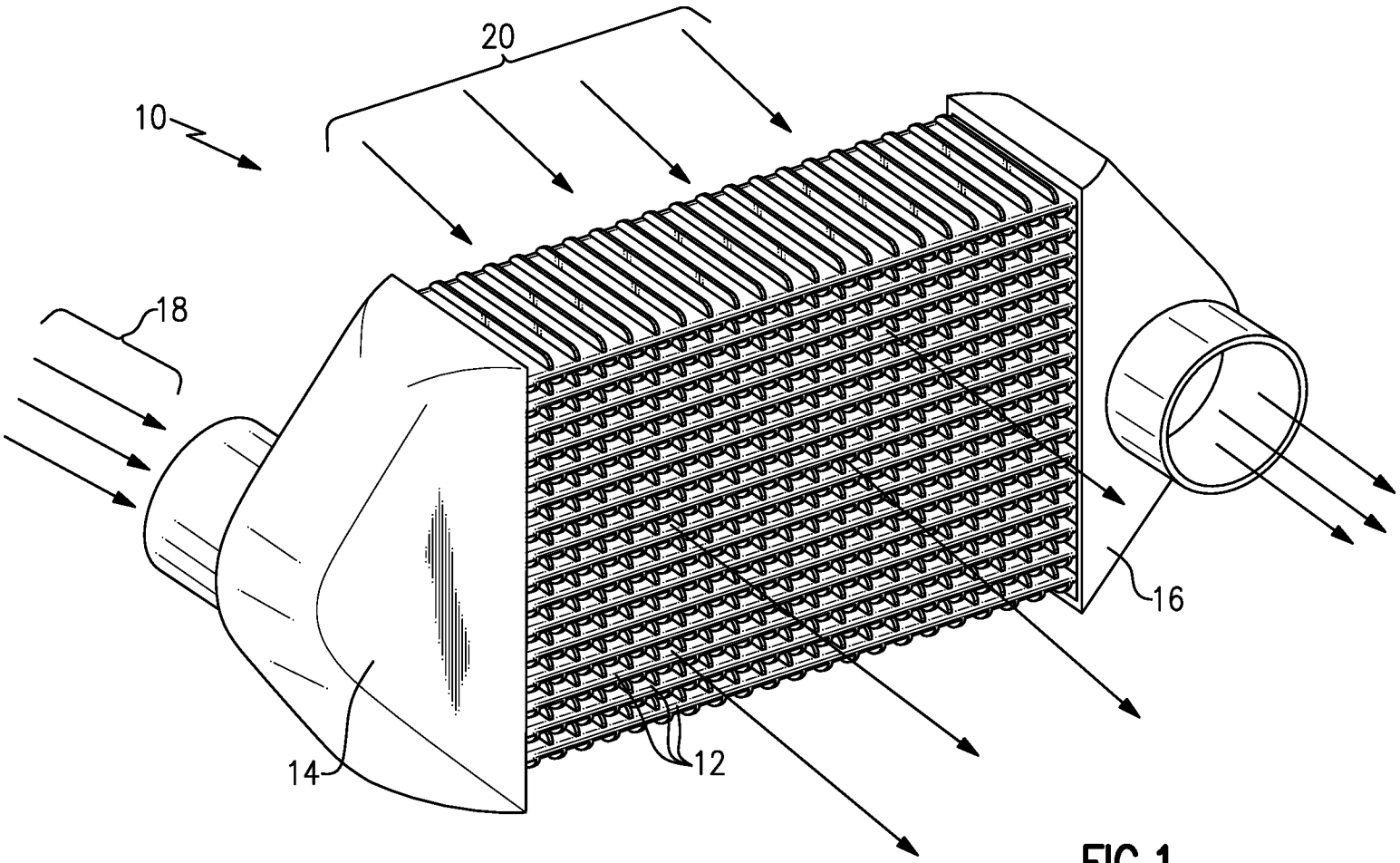
FIG. 1 is a perspective view of an example heat exchanger.

Referring to FIG. 1, a heat exchanger 10 is shown and includes a plurality of plates 12 stacked between an inlet manifold 14 and an outlet manifold 16. The plurality of plates 12 define passages for a hot flow schematically shown at 18. An external cooling flow 20 flows along an outer surface of each of the plurality of plates 12 and accepts heat from the hot flow 18. It should be understood that although a plurality of plates 12 are shown, it is within the contemplation of this disclosure that any number of plates 12 including a single plate 12 could be utilized for the heat exchanger 10.

Figure 2:
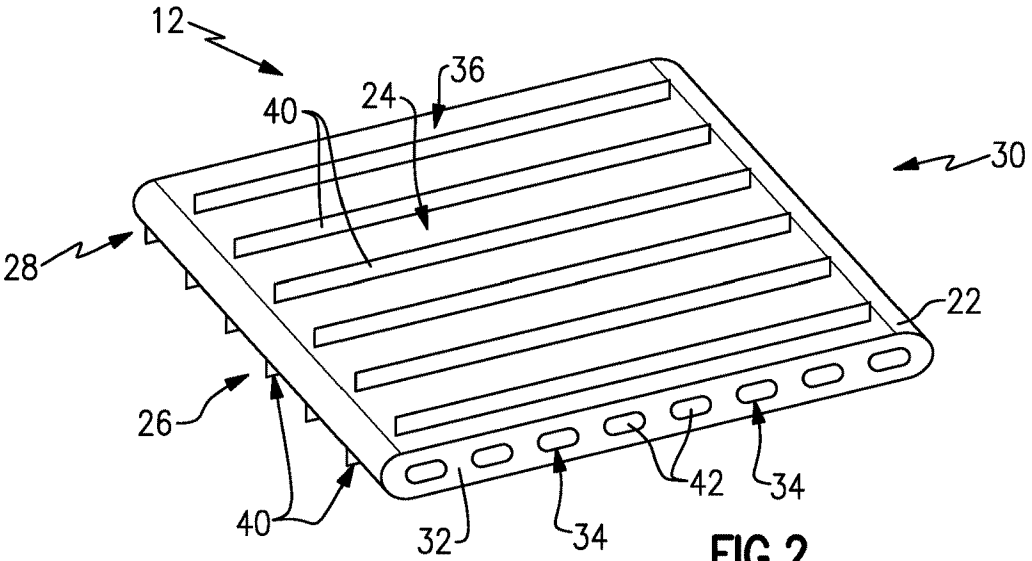
FIG. 2 is a perspective view of an example plate.

Referring to FIG. 2 with continued reference to FIG. 1, an example cast plate 12 includes a leading edge 28, a trailing edge 30, an inlet side 32 and an outlet side 36. A plurality of passages 42 extend from the inlet side 32 to the outlet side 36. Each of the passages 42 are open on the inlet side 32 at a corresponding plurality of inlets 34. In this example the cast plate 12 includes a single plate portion 22 with a plurality of cast fins 40 extending from a top surface 24 and a bottom surface 26.

The disclosed plate 12 is a single cast part that includes the integral plate portion 22 and cast fins 40 that extends from both the top surface 24 and the bottom surface 26. Hot flow 18 enters the inlets 34 and flows through passages 42 to the outlet side 36. Thermal energy within the hot flow 18 is transferred to the cooling flow 20 through the top and bottom surfaces 24, 26. It should be appreciated that the terms hot flow 18 and cooling flow 20 are used by way of description of a disclosed example embodiment and are not meant to be limiting.

Figure 3:
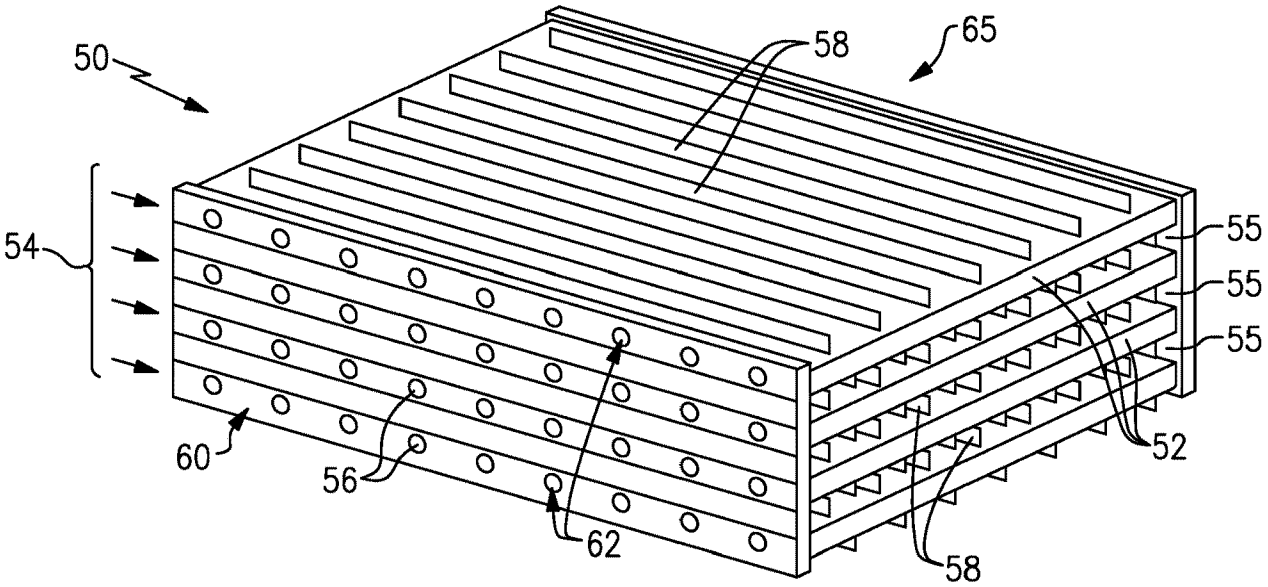
FIG. 3 is a perspective view of another example cast plate.

Referring to FIG. 3 another example cast plate 50 embodiment is shown and includes a plurality of plate portions 52 that are arranged vertically and include cooling air channels 55 therebetween. Each of the plate portions 52 define a plurality of internal passages 56 that extend from an inlet side 62 and outlet side 65. Each of the plate portions 52 include a plurality of fins 58 that provide additional surface area for transferring thermal energy to the cooling air flow 20. The plurality of passages 56 within the cast plate 50 correspond with the plate portions 52 and are arranged in rows 54 that are stacked vertically and extend horizontally.

Differences in temperatures between the hot flow 18 and the cooling flow 20 create thermal differences within different portions of the cast plate 12, 50. The differences in temperature create thermal gradients that can create mechanical stresses and detract from the efficient thermal transfer between flows 18, 20. The example cast plates 12, 50 include features to spread the thermal transfer and enable a more uniform thermal gradient.

Figure 4:
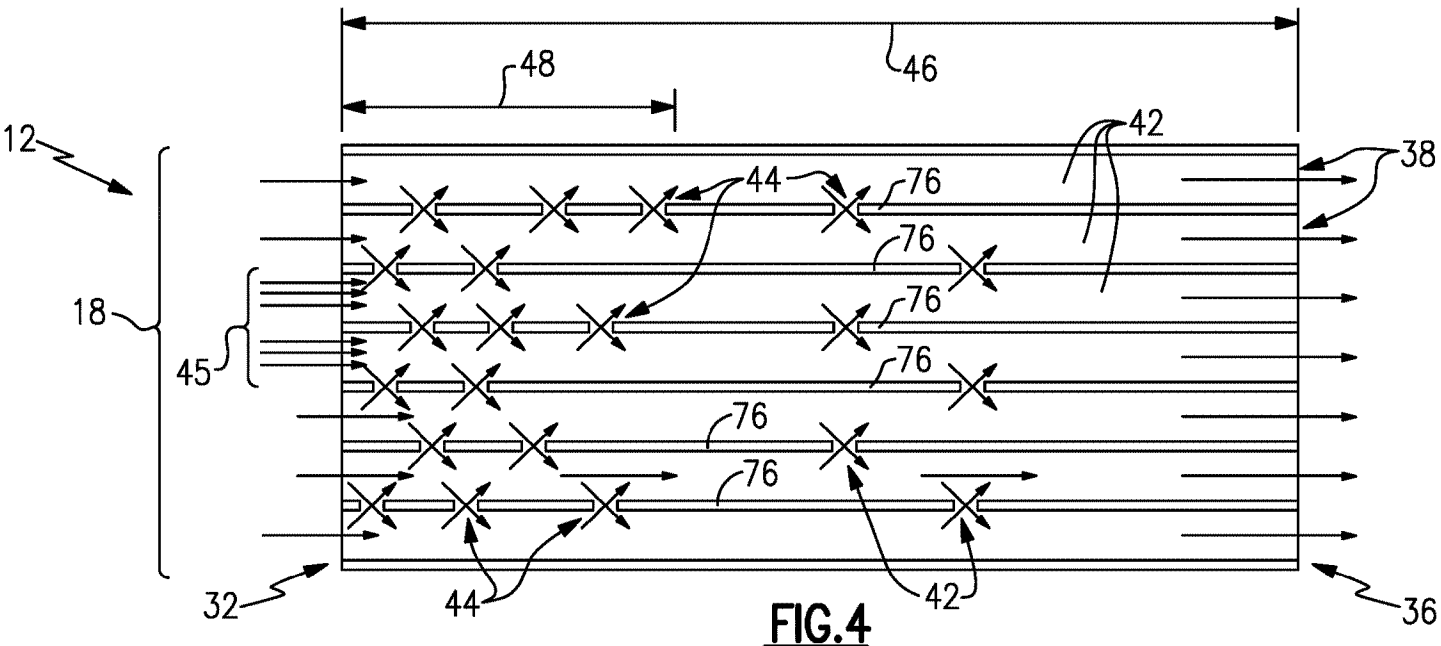
FIG. 4 is a schematic view of passages through a cast plate.

Referring to FIG. 4 with continued reference to FIGS. 2 and 3, a plate portion 22 is shown schematically and includes the passages 42 arranged side by side and separated by internal walls 76. In this disclosed example the passages 42 are arranged in a single row and extend parallel to each other. The internal walls 76 and the passages 42 extend between the inlet side 32 and an outlet side 36. A total length 46 between the inlet side 32 and the outlet 36 is schematically shown for the passages 42. Hot flow 18 entering the inlet side 32 may not be uniformly distributed across the passages 42. Instead, more of the hot flow 18 may enter passages 42 more to the center as is schematically shown at 45. The uneven distribution of flows between the passages 42 can create non-uniform pressures and thermal transfer. As appreciated, spreading the hot flow 18 uniformly across all the passages 42 provides a more uniform thermal gradient and thermal transfer. Accordingly, the example plate 12 includes features for spreading the hot flow 18 across the passages 42.

In a disclosed example embodiment a plurality of crossover passages 44 are provided through the internal walls 76 to provide crossflow between the passages 42 to reduce uneven flow and pressure distribution among the passages 42. The crossover passages 44 provide fluid communication that uniformly distributes pressure, flow and heat across all the passages 42. A more uniform distribution of flow 18 enables improvements in thermal transfer efficiency.

Each of the plurality of crossover passages 44 communicate pressure and incoming flow between adjacent ones of the plurality of passages 42. The crossover passages 44 can be arranged in different manners among the plurality of passages 42 to provide a predefined pressure, flow and thermal distribution. Moreover, pressure, flow and thermal distribution may be provided such that a plurality of crossover passages 42 are provided between two adjacent passages 42 according to a predefined spacing and distribution. In one disclosed embodiment a plurality of crossover passages 42 are provided between any two adjacent passages 42 along the length between the inlet 32 and the outlet 36.

In another disclosed embodiment the plurality of crossover passages 44 are distributed in a non-uniform manner to accommodate regions with the most uneven pressure, flow and thermal distributions. In the disclosed example, incoming flow 18 is the most uneven near the inlet side 32. Therefore, to even out the incoming flow 18, a greater number of crossover passages 44 are provided closer to the inlet side 32 to even flow out quickly to generate a more uniform flow through the passages 42. In one disclosed example, the number or density of crossover passages within a first length 48 from the inlet side 32 is greater than the density of crossover passages 44 downstream. In this example embodiment, the first length 48 is no more than 15% of the total length 46. In another disclosed example embodiment, the first length 48 is no more than 10% of the total length 46. The increased number of crossover passages 44 within the first length 48 provides for a more uniform initial distribution and communication of flow between the passages 42 that reduces o improve overall thermal transfer efficiency.

Moreover, the plurality of crossover passages 44 are arranged to direct airflow towards outside passages. In other words, the plurality of crossover passages 44 are arranged to direct incoming flow from center passages towards the outside passages of the plate 12. Directing the incoming flow 45 toward the outside passages 42 provides a more uniform distribution of pressures, flow and thermal transfer to balance pressures across a width of the plate 12.

Additionally, the crossover passages 44 can be arranged to direct flow in a predefined manner such as from the outside passages 42 toward the inside passages 42. Additionally, the crossover passages 44 need not be arranged to provide a symmetrical crossover flow between passages but may be placed to accommodate local flow and thermal inconsistencies.

Figure 5:
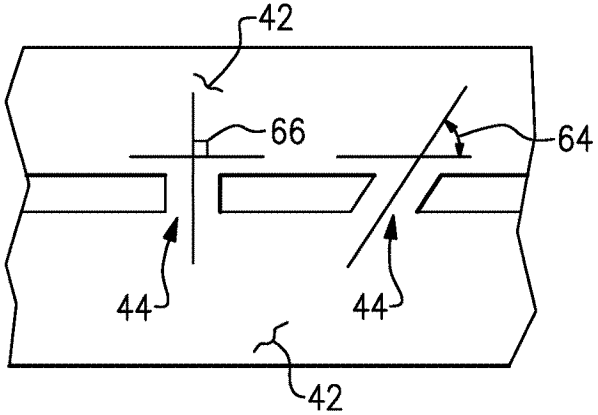
FIG. 5 is enlarged cross-sectional view of a portion of the example plate.

Referring to FIG. 5 with continuing reference to FIG. 4 each of the crossover passages 44 are orientated through one of the internal walls 76. The crossover passages 44 may be disposed normal or at an angle relative to the internal walls 76. In one disclosed example embodiment, the crossover passage 44 is disposed at a right angle indicated at 66 to the internal wall 76 as indicated at 66.

In another disclosed example, the crossover passage 44 is angled relative to internal surface of the internal wall 76 by an angle 64. In the example embodiment the angle 64 is less than 90 degrees. In another disclosed example the angle 64 is about 45 degrees. As appreciated, the angle of the crossover passage 44 is provided to encourage flow between channels and to provide defined flow properties and thus may vary to achieve the desired flow mixing and properties. Moreover, in the disclosed examples, the crossover passages 44 are angled in a direction common to the flow direction to provide smooth transitions and flow between passages 42.

Figure 6:
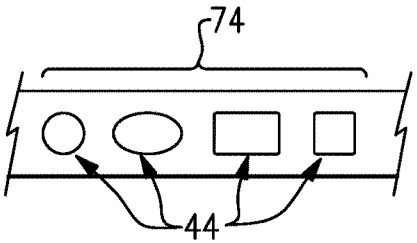
FIG. 6 is schematic view of cross-sectional shapes for the example crossover passages.

Referring to FIG. 6 each of the example crossover passages 44 include a cross-section that may correspond to the cross-section of the plurality of passages 42 or may be of a different shape. The cross-section of each crossover passages 44 may be one of a circular shape, an elliptical shape, a rectilinear shape, or a stadium shape as is schematically indicated at 74. It should be appreciated that although various cross-sectional shapes are illustrated by way of example, other shapes are within the scope and contemplation of this disclosure. Moreover, the size of each of the crossover passages 44 may vary depending on application specific requirements and flows through the various passages. Additionally the shape of the crossover passages 44 may the same across all crossover passages 44 within a cast plate 12 or may be varied within a cast plate 22. Accordingly, the plurality of crossover channels may vary in size, shape and number depending on predefined application specific flow characteristics.

Figure 7:
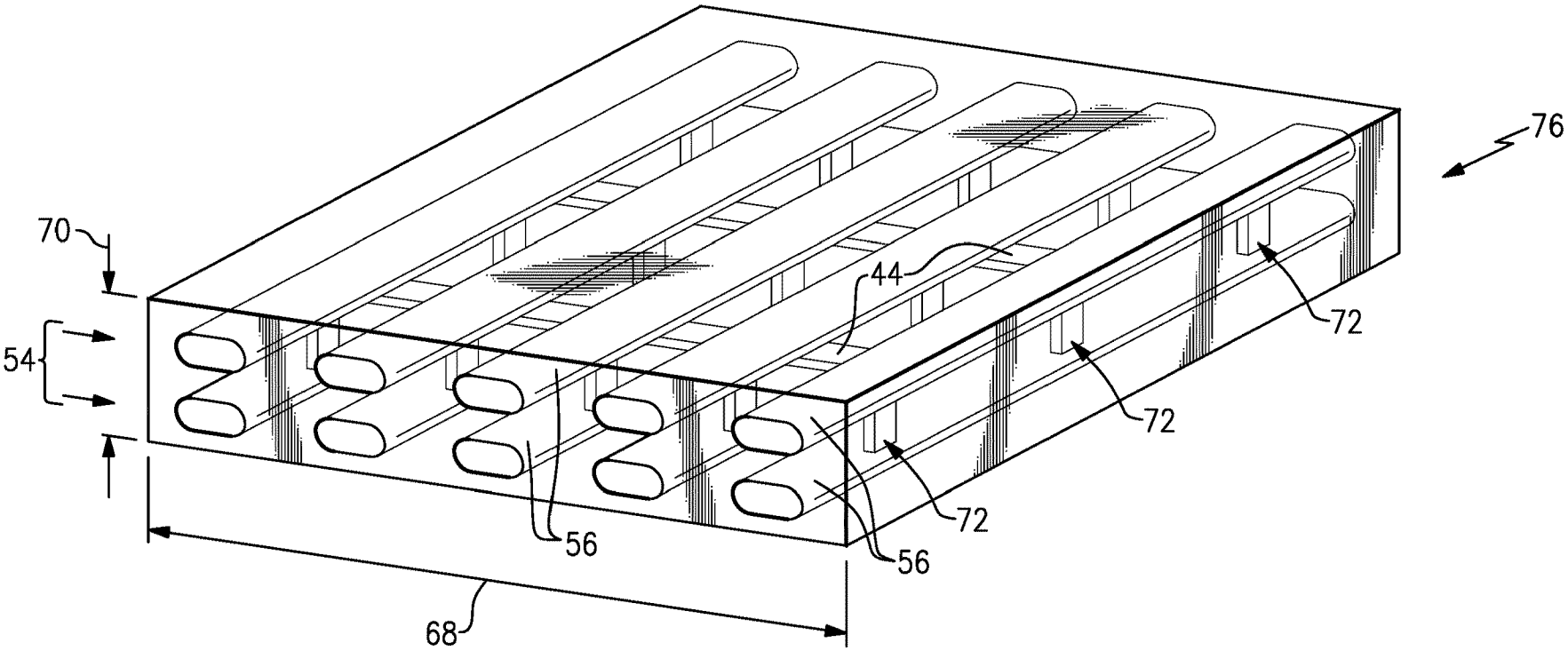
FIG. 7 is a perspective view of another example cast plate.

Referring to FIG. 7, another cast plate 76 includes rows 54 of passages 56. The rows 54 are stacked vertically atop each other. Accordingly, the example plate 76 includes a height 70 and width 68. Each of the rows 54 of passages 56 are disposed side by side along the width 68. The rows 54 are stacked atop each other within the height 70. A plurality of crossover channels 72 are provided between the rows 54 to communicate flow and pressure between adjacent vertically orientated rows 54. Within each of the rows a plurality of crossover passages 44 are also provided to communicate between passages 56 in a common one of the rows 54.

The crossover channels 72 provide communication between passages 56 in different rows 54 and may be distributed with different densities along the length of the plate 76 as described and discussed in FIG. 4. Moreover, the size and shape of the crossover channels 72 may vary as discussed with regard to FIG. 6.

Figure 8:
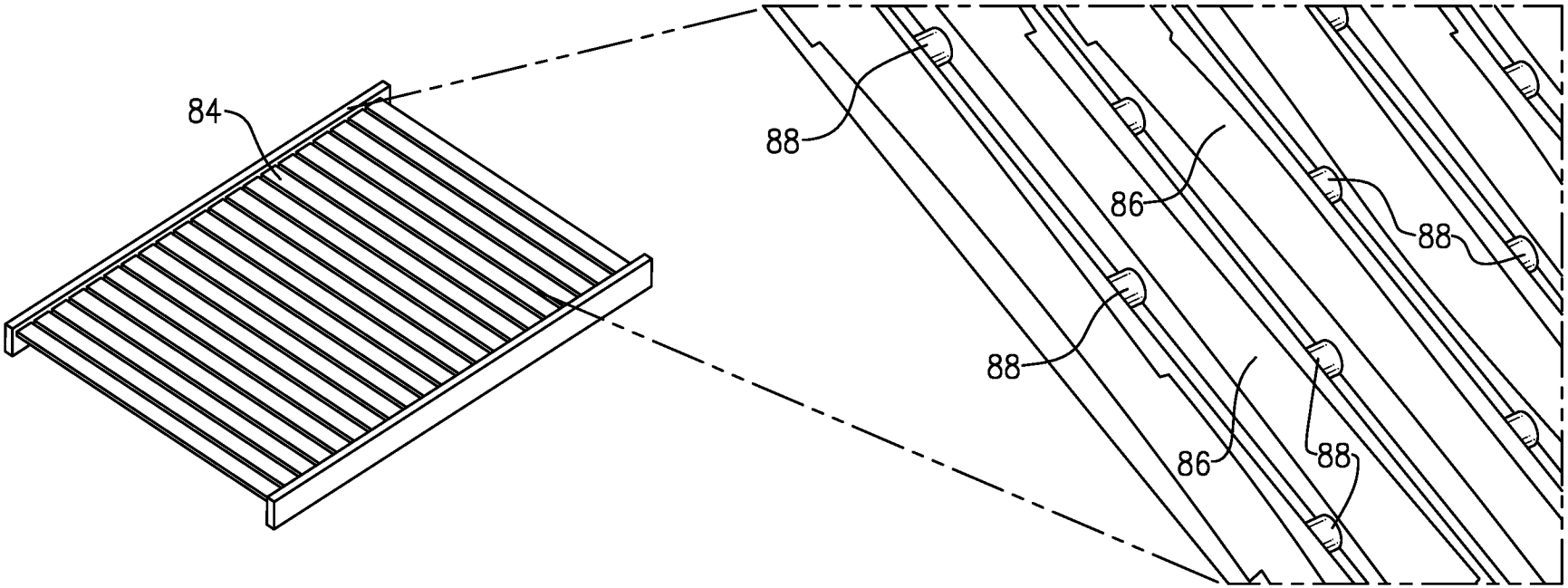
FIG. 8 is a schematic view of an example hot core plate.
Figure 9:
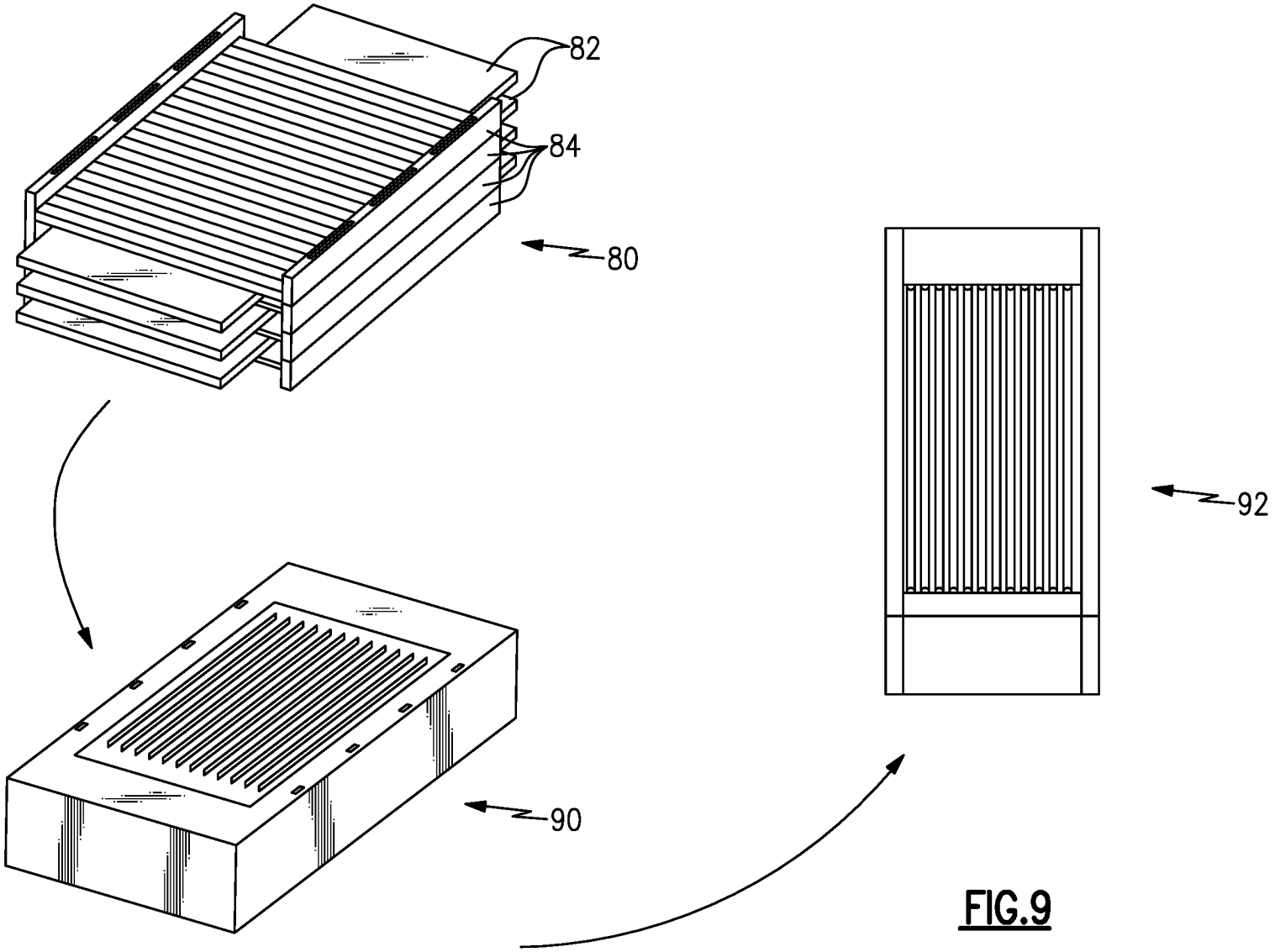
FIG. 9 is a schematic view of an example core and mold core assembly for forming a cast plate.

Referring to FIGS. 8 and 9, the example cast plates 12, 50 are single unitary cast items and are fabricated using casting techniques that include the use of a core assembly 80. The example core assembly 80 includes plates 82 that form cold side or external features of a cast plate 12, 50 and hot side plates 84. The hot side plates 84 define internal features including the passages 42 and the crossover passages 44 in the completed cast plate. The core assembly 80 is utilized to form a wax pattern schematically shown at 90. The wax pattern 90 is then utilized to form a mold core 92 according to known processes and methods.

The example hot plate 84 includes a plurality of features 86 that are intended to define the passages 42. In this example the plurality of passage forming features 86 for defining the passages 44 extend in a parallel manner across a plate width. A plurality of crossover forming features 88 are provided between the features 86 to form the crossover passages 44.

It should be appreciated that the specific features 86 and 88 forming the hot plate 84 are strengthened by the inclusion of the features 88 to form the crossover passages 44. As is understood in casting processes, the core plate 84 is a solid structure about which a molten material is cured. Once the molten material is cured, the core plate 84 is removed leaving the empty spaces forming the passages 42 and crossover passages 44. The example heat exchanger plates 12 include a plurality of passages 42 with a large length to width ratio. Accordingly, the features 88 may not be as robust as desired. Including the additional material for the features 88 to form the crossover passages 44 increases rigidity of the core plate 84 to improve robustness.

Accordingly the example cast heat exchanger plate includes crossover passages that improve the function of the completed heat exchanger assembly while also adding stability that aids in the fabrication process.

Although an example embodiment has been disclosed, a worker of ordinary skill in this art would recognize that certain modifications would come within the scope of this disclosure. For that reason, the following claims should be studied to determine the scope and content of this disclosure.

What is claimed is:

1. A heat exchanger comprising:

a plate portion including a plurality of internal passages extending between an inlet and an outlet, wherein the plate portion is a one piece cast part including a plurality of cast fins extending from an outer surface; and a plurality of crossover passages for providing fluid communication between adjacent ones of the plurality of internal passages between the inlet and the outlet, wherein the plurality of crossover passages are distributed in a non-uniform manner with a greater number of crossover passages provided closer to the inlet than to the outlet such that more crossover passages are disposed within a first length from the inlet that is no more than 15% of a total length between the inlet and the outlet than are disposed after the first length.

2. The heat exchanger as recited in claim 1, wherein the plurality of internal passages are separated by internal walls and the plurality of crossover passages extend through the internal walls.

3. The heat exchanger as recited in claim 1, wherein the first length is no more than 10% of the total length between the inlet and the outlet.

4. The heat exchanger as recited in claim 1, wherein each of the plurality of crossovers passages are transverse to the plurality of internal passages.

5. The heat exchanger as recited in claim 1, wherein at least one of the plurality of crossover passages are disposed at an angle relative to the internal passages that is greater than 90 degrees.

6. The heat exchanger as recited in claim 1, wherein the plate portion includes a width with a first side and a second side and the plurality of internal passages are aligned across the width and the plurality of crossover passages direct flow between the plurality of internal passages toward the first side and the second side.

7. The heat exchanger as recited in claim 6, wherein the plurality of crossover passages are angled in a direction common to the flow direction.

8. The heat exchanger as recited in claim 1, wherein the plate portion includes a width with a first side and a second side and the plurality of internal passages are aligned across the width and the at least one means for providing fluid communication between at least two of the plurality of internal passages comprises a plurality of crossover passages that direct flow between the plurality of internal passages toward a center between the first side and the second side.

9. The heat exchanger as recited in claim 1, wherein the at least one crossover passage includes a cross-sectional shape that is one of circle, oblong, stadium and elliptical.

10. The heat exchanger as recited in claim 1, wherein the plurality of internal passages includes at least two rows of passages spaced apart vertically and the at least one crossover passages extends between at least two internal passages in different rows.

11. The heat exchanger as recited in claim 1, wherein at least one of the plurality of crossover passages are disposed at an angle relative to the internal passages that is 45 degrees.

12. A cast heat exchanger plate comprising:

a one piece cast plate portion including a plurality of cooling fins extending from an outer surface;

at least one internal wall defining at least two internal passages extending between an inlet and an outlet within the cast plate portion; and a plurality of crossover passages extending through the internal wall providing fluid communication between the at least two internal passages, wherein the plurality of crossover passages are distributed in a non-uniform manner with a greater number of crossover passages provided closer to the inlet than to the outlet such that more crossover passages are within a first length from the inlet that is no more than 15% of a total length between the inlet and the outlet than are disposed after the first length.

13. The cast heat exchanger plate as recited in claim 12, wherein the at least two internal passages are spaced apart vertically within separate rows of internal passages and the at least one crossover passages extends between at least two internal passages in separate rows.

14. A core assembly for a heat exchanger comprising:

at least one core plate defining internal features of a heat exchanger plate portion, the core plate including passage defining features disposed between gaps defining at least one internal wall between at least two internal passages; and a plurality of crossover features between the passage defining features for defining a plurality of crossover passages through the internal wall providing fluid communication between the at least two internal passages, wherein the plurality of crossover passages comprises a plurality of crossover features arranged between ends of the passage defining features and more of the plurality of crossover features are distributed in a non-uniform manner with a greater number of crossover passages provided closer to the inlet than to the outlet such that more crossover passages are provided within a first length from a first open end that is no more than 15% of a total length between open ends.

15. The core assembly as recited in claim 14, wherein the at least one core plate comprises a cold side plate that defines external features of a cast plate of a completed heat exchanger.

16. The core assembly as recited in claim 15, wherein the at least one core plate further includes a hot side plate that defines internal features of the cast plate of the completed heat exchanger.

17. The core assembly as recited in claim 16, wherein the hot side plate is stackable atop another hot side plate to define a plurality of rows of internal passages and a cold side plate is disposed on top and bottom sides of each hot side plate.

18. The cast heat exchanger plate as recited in claim 14, wherein the first length from the inlet is not more than 10% of the total length between the inlet and the outlet.

19. The cast heat exchanger as recited in claim 18, further comprising at least two one piece cast plate portions spaced apart from each other and defining a passage for cooling airflow with the space between cast plate portions.

* * * * *